United States Patent [19]

Serio et al.

[11] Patent Number: 4,829,212

[45] Date of Patent: May 9, 1989

[54] CATHODE RAY TUBE WITH INTERNAL ELECTRICAL CONNECTIONS MEANS

[75] Inventors: Giovanni Serio; Martinus C. M. Verhoeven, both of Eindhoven, Netherlands

[73] Assignee: U.S. Philips Corporation, New York, N.Y.

[21] Appl. No.: 188,243

[22] Filed: Apr. 29, 1988

[30] Foreign Application Priority Data

May 1, 1987 [NL] Netherlands ..... 8701031

[51] Int. Cl.[4] ..... H01J 29/07

[52] U.S. Cl. ..... 313/406; 313/482; 313/407

[58] Field of Search ..... 313/402, 404, 405, 406, 313/407, 408, 477 R, 477 HC, 482; 439/877, 878, 881

[56] References Cited

U.S. PATENT DOCUMENTS 4,230,965 10/1980 Brenner, Jr. ..... 313/407
4,230,966 10/1980 Compen ..... 313/402 X
4,644,222 2/1987 Brunn ..... 313/402 X

*Primary Examiner*—Palmer C. DeMeo
*Assistant Examiner*—Sandra L. O'Shea
*Attorney, Agent, or Firm*—John C. Fox

[57] ABSTRACT

The electrical connection between the shadow mask and screen of a cathode ray tube is provided by a contact spring, one end of which engages one of the metal mask support pins upstanding from the sidewall of the tube's faceplate, and the other end of which contacts the electrically conductive layer overlying the screen. Engagement with the pin occurs at a transition region between the conical base portion and the spherical head of the pin, and produces a simple and reliable electric connection between the shadow mask and the electrically conductive layer.

4 Claims, 3 Drawing Sheets

CATHODE RAY TUBE WITH INTERNAL ELECTRICAL CONNECTIONS MEANS

BACKGROUND OF THE INVENTION

The invention relates to means for electrically connecting the shadow mask to an internal conductive layer of a cathode ray tube. A cathode ray tube typically comprises an envelope having a neck containing an electrode system for generating three electron beams, and a substantially rectangular display window, the inside surface of which carries a display screen with phosphor elements luminescing in different colours. The display screen is coated with an electrically conductive layer. A substantially rectangular shadow mask comprising a large number of apertures, is positioned adjacent the display window, and directs each electron beam to luminescent phosphor elements of one colour. The shadow mask is attached to a substantially rectangular supporting frame. The supporting frame is suspended in the display window from pins connected to an upright edge portion of the display window, each of which has at least partly the shape of a truncated cone. The shadow mask is electrically connected to the conductive layer by at least one contact spring, a part of which engages one of the pins and another part of which engages the layer.

Such a cathode ray tube is known from German Offenlegungsschrift 26 22 695. The electric connection between the shadow mask and the electrically conductive layer in this case is produced by at least one contact spring which is interposed between a mask suspension means and a pin having the shape of a truncated cone, and which is fixed on the pin by the suspension means.

The pressure which the contact spring exerts on the electrically conductive layer depends upon the distance between the place where the contact spring engages the suspension means and the point of electrical contact with the conductive layer. If a good electric connection is to be produced for various types of cathode ray tubes having tolerances in the dimensions of the shadow mask and/or the display window, contact springs of different types or with varying tolerances are necessary. Moreover, since the contact spring engages the suspension means in a resilient manner, the contact spring can perform different movements with respect to the display window for example, vibrations present in the shadow mask transmitted to the suspension means, can result in the contact spring rubbing the electrically conductive layer so that the electric connection is detrimentally influenced.

SUMMARY OF THE INVENTION

It is an object of the invention to provide a cathode ray tube having a simple electric connection of the shadow mask to the electrically conductive layer on the screen, which substantially avoids the above-mentioned detrimental influences.

For this purpose, the cathode ray tube according to the invention is characterized in that the pin comprises a gradually narrowing base portion and a gradually widening free end, and in that the at least one contact spring is connected onto the pin in a clamping manner, at least a part of the contact spring engaging the gradually widening free end. As a result, the contact spring is fixed by the pin and a good electric connection is obtained between the shadow mask and the electrically conductive layer which is no longer detrimentally influenced by vibrations. Furthermore the contact spring may be chosen independently of the differences in size of the shadow mask and/or display window. The gradually widening free end may have different shapes, for example, a cone or a ball. The use of pins having a gradually widening free end in the form of a ball for suspending the supporting frame and the shadow mask is known, for example, from U.S. Pat. No. 4,644,222.

The invention is based on the recognition that a pressure can be built up by connecting a contact spring in a clamping manner on a pin having a gradually widening free end with at least a part of the contact spring engaging the gradually widening free end, so that the contact spring engages the electrically conductive layer under a pre-stress. The advantage is that the contact spring and the display window perform the same movement with respect to each other in the case of vibrations since the contact spring is connected to the pin in a clamping manner and the pin is rigidly connected to the display window. As a result, rubbing of the conductive layer by the contact spring at the area where it engages the conductive layer under pressure, e.g., during vibrations, and consequent wearing of the layer, is prevented, and good electric connection is maintained.

An additional advantage is that contact springs may be used which engage the electrically conductive layer under a great pre-stress, which is desirable for a good electric connection between the shadow mask and the electrically conductive layer. When a contact spring is fixed with a great pre-stress by a suspension means of the shadow mask, as described in German Offenlegungsschrift 26 22 695, the direction of the electron beam to the luminescent phosphor elements through the apertures in the shadow mask may be detrimentally influenced. In a cathode ray tube according to the invention the contact spring and the suspension means both engage the pin, but are separated from each other so that the contact spring does not adversely influence the suspension means, even in the case of a great pre-stress.

In a preferred form of a cathode ray tube in accordance with the invention, the part of the contact spring which engages the gradually widening free end of the pin comprises two projections defining a central recess, and fitting in a clamping manner around the transition from the truncated cone of the pin to the gradually widening free end of the pin. As a result of the pre-stress on the contact spring, the spring is readily fixed and consequently is difficult to move.

In a further preferred form of a cathode ray tube in accordance with the invention, the contact spring is a flat metal element having a flat body portion comprising the two projections defining the central recess, at such an angle with the flat body portion that the two projections engage a part of the cone. Optimal fixing is obtained in that the two projections situated on each side of the recess engage a part of the cone, the flat portion of the flat metal element in which the recess is provided engaging the gradually widening free end. Even in the case of a blow or shock, for example when the cathode ray tube is dropped, the contact spring will remain firmly connected to the pin and ensures a good electric connection. As a result the contact spring may be given a greater pre-stress.

In an alternative preferred form of a cathode ray tube in accordance with the invention, the contact spring is a looped metal wire, the ends of which engage the conductive layer, and the mid-portion comprising an arcuate portion for engaging the transition region of the pin.

BRIEF DESCRIPTION OF THE DRAWINGS

The invention will now be described in greater detail with reference to the drawing in which.

DESCRIPTION OF THE PREFERRED EMBODIMENTS

Figure 1:
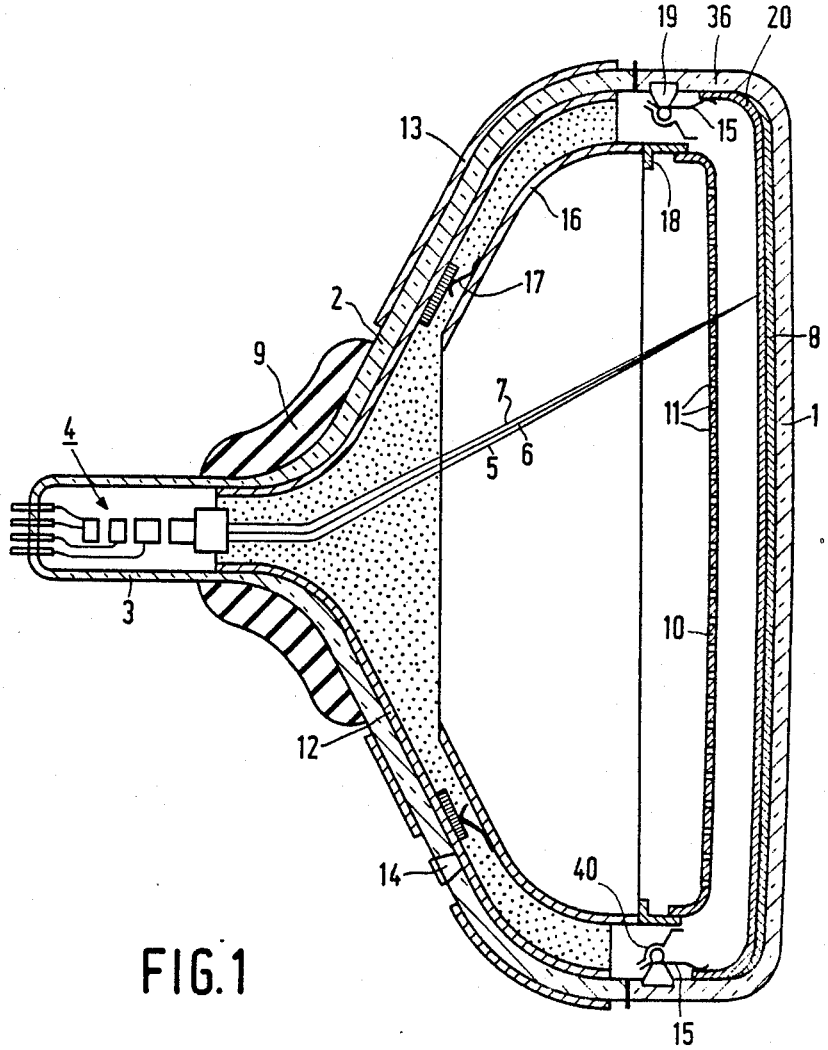
FIG. 1 is a horizontal sectional view of a cathode ray tube according to the invention.

In the horizontal sectional view of FIG. 1 the cathode ray tube comprises a glass envelope consisting of a display window 1, a cone 2 and a neck 3. An electrode system 4 having three electron guns for generating three electron beams 5, 6 and 7 is provided in the neck 3. The electron beams are generated in one plane (in this case the plane of the drawing) and are directed to a display screen 8, which is provided internally on the display window 1, comprises a large number of phosphor elements luminescing in green, red and blue, and is coated with an aluminium layer 20. The phosphor elements maay be, for example in the form of dots or strips. The invention will hereinafter be described, by way of example, with reference to elements in the form of strips, the longitudinal direction of which is perpendicular to the plane through the electron guns (in this case perpendicular to the plane of the drawing). On their way to the display screen 8, the electron beams 5, 6 and 7 are deflected over the display screen 8 by means of a number of deflection coils 9 placed around the envelope coaxially with the tube axis. The deflected beams pass through a shadow mask 10 which consists of a metal plate having elongated apertures 11, the longitudinal direction of which is parallel to the phosphor elements of the display screen 8. The three electron beams 5, 6 and 7 pass through the apertures 11 at a small angle with respect to each other, and consequently each impinge only on phosphor elements of one colour.

The cathode ray tube further comprises an internal resistance layer 12 and a readily conducting layer 13 provided externally on the cone 2. The resistance layer 12 is connected to a high voltage contact 14 provided in the wall of the tube.

The shadow mask 10 is connected to a supporting frame 18, which is suspended in the cathode ray tube by engagement of suspension means 40 with metal pins 19 extending from the upright edge 36 of the display window 1. Contact springs 15 are connected to the pins 19 in a clamping manner and extend forward to make electrical contact with aluminum layer 20. Since the shadow mask 10 is suspended on the metal pins 19. The shadow mask 10 is thus electrically connected to the aluminium layer 20 via frame 18, suspension means 40, pins 19 and contact springs 15.

During operation of the tube the layers 12 and 20 are at an operative potential of approximately 25 kVolt and the layer 13 is at ground potential because it is connected to the chassis of the picture display apparatus, of which the cathode ray tube forms a part. A metal screening cone 16 is connected at one end to the shadow mask 10 and at the other end to the resistance layer 12 by means of contact springs 17 to screen the electron beams from the earth's magnetic field.

Figure 2:
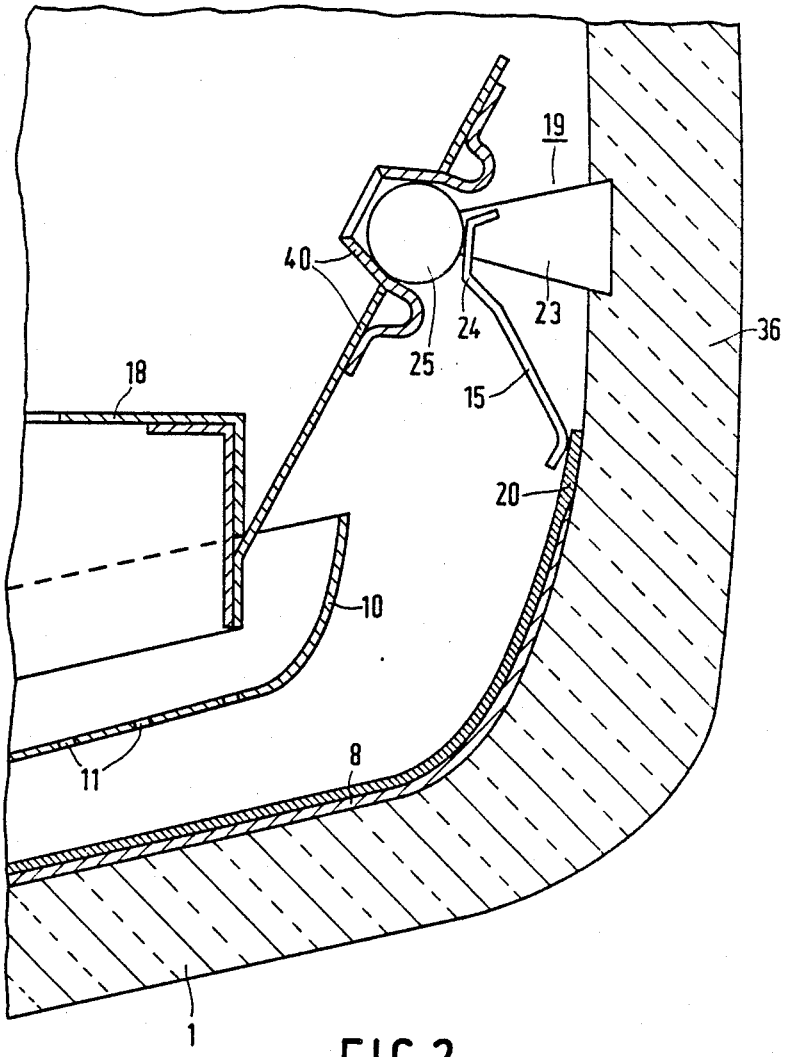
FIG. 2 is a sectional view on an enlarged scale of a part of the cathode ray tube according to the invention.

FIG. 2 shows a part of the cathode ray tube according to the invention on an enlarged scale. Pin 19 comprises a base 23 in the form of a truncated cone and a gradually widening free end 25 in the form of a ball. The mask frame 18, supporting the shadow mask 10, is itself supported by engagement of a suspension means 40 with the ball-shaped end 25 of the pin. The base 23 of the pin 19 is connected to the upright edge 36 of the display window 1, for example by embedding the base 23 partly into the upright edge 36 while in a softened state, by thermocompression bonding. The contact spring 15 is pre-stressed and connected to the pin 19 in a clamping manner, at least a portion 24 of the contact spring 15 engaging the ball-shaped end 25 under pressure, and the free end engaging the electrically conductive layer 20 under pressure.

Since the contact spring 15 is connected in a clamping manner on the pin 19 which in turn is fixed in the upright edge 36, in the event of vibrations, relative movement between the contact spring and the electrically conductive layer, and consequently wearing of this layer, does not occur. The electric connection between the shadow mask 10 and the electrically conductive layer 20 is thus maintained. Moreover, the contact spring 15 is not adversely influenced by vibrations which are present in the shadow mask 10, since contact spring 15 is separated from suspension means 40.

Figure 3A:
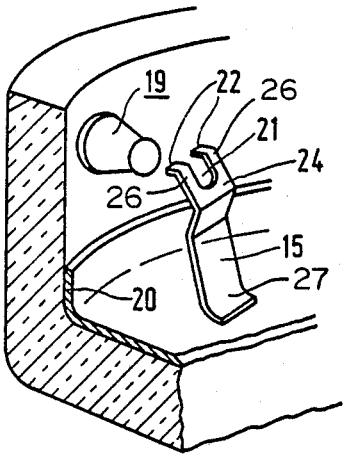
FIG. 3 is a perspective view of a corner region of a cathode ray tube face panel, showing a pin and one embodiment of a contact spring of the invention.
FIG. 3*b* is a section view of the embodiment of FIG. 3*a*, showing the contact spring engaging the pin.
Figure 3B:
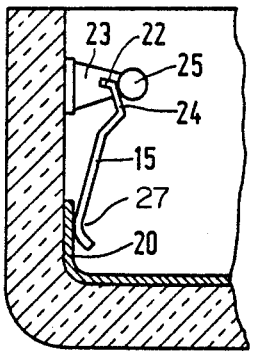

FIG. 3*a* is a perspective view of a preferred form contact spring according to the invention, in which the contact spring is shown disconnected from the pin for clarity. The contact spring 15 is manufactured from a flat metal element having a flat portion 24 comprising legs 26 defining a recess 21. End portions or projections 22 of legs 26 form an angle with flat portion 24. The contact spring 15 is clamped onto the pin 19 by prestressing the contact spring 15 and moving the flat portion 24 1 such that legs 26 engage the pin 19 in the transition region between the conical base 23 and the ball-shaped end 25. The contact spring 15 fits around the pin 19 in a clamping manner when, for example, the cross-section of the recess 21 in the initial position is slightly smaller than the cross-section of the transition from the conical base 23 to the ball-shaped end 25 of the pin 19. As a result of this, disengagement of the contact spring 15 from the pin 19 in the event of vibrations of the cathode ray tube is unlikely. FIG. 3*b* shows the contact spring connected to the pin.

An even firmer connection of the contact spring 15 on the pin 19, which is insensitive to blows or shocks, for example when the cathode ray tube is dropped, is obtained when the two projections 22 are at such an angle with the flat portion 24 that, when the contact spring 15 is clamped onto the pin 19, the two projections 22 engage a portion of the conical base 23. The pre-stress to which contact spring 15 is subjected forces flat portion 24 against ball 25, projections 22 against conical portion 19, and the free end against conductive layer 20.

Figure 4A:
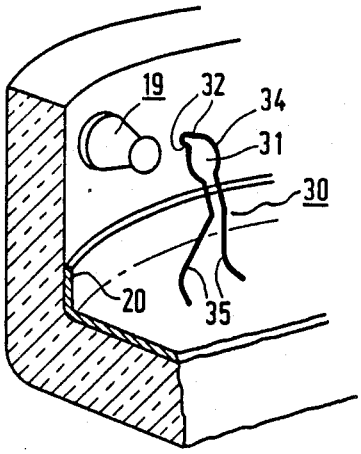
FIG. 4*a* is a perspective view similar to that of FIG. 3*a* for another embodiment of a contact spring of the invention.
Figure 4B:
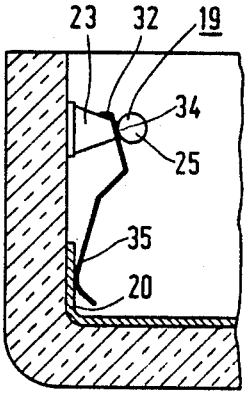
FIG. 4*b* is a section view of the embodiment of FIG. 4*a*, showing engagement of the contact spring with the pin.

Although the contact spring 15 produces a good electric connection between the shadow mask and the layer, clamping the contact spring onto the pin may be impeded due to the restricted space between the pin and the front of the display window. FIG. 4*a* is a perspective view of a second preferred embodiment of a contact spring according to the invention in which, again for clarity, the contact spring is shown disconnected from the pin. The contact spring 15 is manufactured from a metal wire 30, the ends 35 of which engage the conductive layer 20, as is shown in FIG. 4*b*. The wire 30 comprises an arcuate portion 34 defining a recess 31. To engage the pin 19, the contact spring 15 is slide onto the pin 19 from a position above the pin, so that the arcuate portion 34 of the wire 30 fits in a clamping manner around the transition region between the conical base 23 and the ball-shaped end 25. The arcuate portion 34 further comprises two projections 32 which, when the wire 30 is connected onto the pin 19, engage the conical base 23. The wire 30 can be mounted on the pin 19 without any difficulty and engages the conductive layer 20 with its ends 35 under a pre-stress so that a good electric connection is produced.

It will be obvious that the invention is not restricted to the preferred embodiments described but that many variations are possible to those skilled in the art without departing from the scope of this invention.

What is claimed is:

1. A cathode ray tube comprising: a glass envelope having a neck containing an electrode system for generating three electron beams, and a substantially rectangular display window having an upright edge, the inside surface of which carries a display screen having phosphor elements luminescing in different colours, the display screen being coated with an electrically conductive layer; a substantially rectangular shadow mask comprising a large number of apertures which direct each electron beam to luminescent phosphor elements of one colour; a substantially rectangular supporting frame to which the shadow mask is connected; and pins connected to the upright edge for engagement with suspension means for suspending the supporting frame in the display window, the shadow mask being connected electrically to the conductive layer by at least one contact spring, a part of which engages one of the pins and another part of which engages the layer, characterized in that the pin comprises a gradually narrowing base portion and a gradually widening free end, and the contact spring is connected to the pin in a clamping manner, at least a part of the contact spring engaging the gradually widening free end.

2. A cathode ray tube as claimed in claim 1, in which the part of the contact spring which engages the gradually widening free end of the pin comprises two projections defining a central recess, said projections fitting in a clamping manner around the transition region between the gradually narrowing base portion and the gradually widening free end of the pin.

3. A cathode ray tube as claimed in claim 2, in which the contact spring is a flat metal element, and the two projections are at such an angle with the flat portion that the two projections engage a part of the cone.

4. A cathode ray tube as claimed in claim 2, in which the contact spring is a metal wire, the wire comprising an arcuate portion which surrounds the recess, the arcuate portion including two projections which engage a part of the cone and the wire further comprising two ends portions which engage the conductive layer.

* * * * *